US005794632A

United States Patent [19]

Gueret

[11] Patent Number: 5,794,632

[45] Date of Patent: Aug. 18, 1998

[54] DEVICE FOR PACKAGING AND APPLYING A MAKEUP PRODUCT, IN PARTICULAR MASCARA

[75] Inventor: Jean-Louis Gueret, Paris, France

[73] Assignee: L'Oreal, Paris, France

[21] Appl. No.: 638,213

[22] Filed: Apr. 26, 1996

[30] Foreign Application Priority Data

Apr. 26, 1995 [FR] France ..... 95 05000

[51] Int. Cl.[6] ..... A45D 40/24

[52] U.S. Cl. ..... 132/317; 132/218; 132/318; 132/320; 401/126; 401/129

[58] Field of Search ..... 132/317, 318, 132/319, 320, 286, 218, 293, 297, 313; 401/129, 126

[56] References Cited

U.S. PATENT DOCUMENTS

| | | | |
|---|---|---|---|
| 1,591,616 | 7/1926 | Fearing . | |
| 1,950,324 | 3/1934 | Powers | 132/318 |
| 2,136,779 | 11/1938 | Bednar . | |
| 2,148,736 | 2/1939 | Engel . | |
| 2,964,045 | 12/1960 | Otto et al. | 132/317 |
| 3,033,213 | 5/1962 | Joss et al. | 132/320 |
| 3,384,547 | 5/1968 | Palmerio et al. | 132/317 |
| 4,540,007 | 9/1985 | Carracoy | 401/126 |
| 4,572,224 | 2/1986 | Rosenwinkel et al. | 132/320 |
| 4,711,354 | 12/1987 | Bennett . | |
| 4,982,838 | 1/1991 | Fitjer | 132/318 |
| 5,121,763 | 6/1992 | Kingsford | 132/317 |
| 5,221,153 | 6/1993 | Spatz | 132/320 |

FOREIGN PATENT DOCUMENTS

| | | |
|---|---|---|
| 0162722 | 11/1985 | European Pat. Off. . |
| 0171983 | 2/1986 | European Pat. Off. . |
| 791234 | 12/1935 | France . |
| 1092052 | 4/1955 | France . |
| 2290863 | 6/1976 | France . |
| 2633498 | 1/1990 | France . |
| 91/08692 | 6/1991 | WIPO . |

*Primary Examiner*—Cary E. O'Connor
*Assistant Examiner*—Pedro Philogene
*Attorney, Agent, or Firm*—Oliff & Berridge, P.L.C.

[57] ABSTRACT

A packaging and application device for a makeup product, particularly mascara, includes an elongate body and an applicator that can be accommodated in the body. The applicator has a rod provided at one end with a makeup product application element and the rod is joined at its other end to a gripping element which also constitutes a cap able to close the orifice of the body in which the applicator is engaged. The body has a liquid reservoir in which the application element is engaged. The application element includes an elongate block of the makeup product to be applied.

27 Claims, 6 Drawing Sheets

DEVICE FOR PACKAGING AND APPLYING A MAKEUP PRODUCT, IN PARTICULAR MASCARA

BACKGROUND

1. Field of the Invention

The present invention relates to a device for packaging and applying a makeup product, in particular mascara.

2. Discussion of Related Art

Numerous types of makeup product packaging and application devices are known that comprise an elongate body containing the makeup product and an applicator that can be accommodated in said body and comprise a rod provided at one end with a makeup product application element and joined at its other end to a gripping element which at the same time constitutes a cap able to close the orifice of the body in which the application element is engaged.

The makeup product, depending on its nature, can be packaged in the liquid or paste form or in the form of a solid, friable block, in which case the application element must be moistened before being brought into contact with the makeup product block in order to load the application element with makeup product with a view to use.

The assignee of the present invention, in FR-A 2 633 498, described such a device intended for making up the eyelashes, comprising a mascara block and a reservoir of liquid to moisten the mascara application element. The latter is made in the form of an eyelash brush or a shaped foam or felt tip and is supplied by immersion or by capillarity with the liquid contained in the reservoir which causes the mascara block to crumble. The liquid provided is water or normal saline solution, possibly with cosmetically active agents.

The mascara block is in elongate form with a blind or through axial cavity into which the application element penetrates.

Because of this cavity, the quantity of mascara available is small by comparison to the volume occupied by the mascara block. Moreover, a nonnegligible peripheral part of the mascara block cannot be picked up by the application element and is hence unused.

SUMMARY OF THE INVENTION

The goal of the present invention is to make a packaging and application device for a makeup product, particularly mascara, comprising an elongate body and an applicator that can be accommodated in said body having a rod provided at one end with a makeup product application element and joined at its other end to a gripping element which at the same time constitutes a cap able to close the orifice of the body in which the application element is engaged, said body having a liquid reservoir in which the application element is engaged, characterized in that the application element is comprised of an elongate block of the makeup product to be applied. Preferably, the liquid reservoir has an elastically deformable flexible pad, particularly with a cellular or fibrous structure, provided with an axial cavity to receive the application element.

Since it is the block of makeup product itself that constitutes the application element, it will be understood that the invention allows for optimal utilization of the quantity of packaged makeup product.

The makeup product block according to the invention can be formed directly on the rod of the applicator by any appropriate method, particularly by hot molding.

It is thus very easy to confer any desired shape on the makeup product block, for example cylindrical, conical, or parallelipipedic, and confer on the surface of the block a particular relief by creating flat areas, teeth, grooves, stripes, etc.

The makeup product block according to the invention can also be molded over a brush provided at the end of the rod, in which case it is possible to make an application element in which at least some of the bristles of the brush project from the makeup product block molded onto it. The brush can be twisted or injected. Instead of a brush, a flock-coated rod or a foam can be used.

Instead of making such an application element by molding, it can be made by dipping an applicator that has in particular a brush-shaped element dipped into the makeup product when hot, which thus covers the application element and assumes its shape. If desired, with a brush-shaped application element, all or some of the brush bristles can be left visible.

The makeup product block can also be mounted separably on the rod of the applicator in particular by providing releasable mechanical linking means both on the rod and on the block or on a section of the rod on which the block is mounted. In this way, a reloadable applicator can be made.

The device according to the present invention can also have in addition a finishing application element of the conventional type, particularly in a brush form, accommodated in the gripping part of the applicator or at the end of the body opposite the end receiving the applicator.

The device according to the invention can also have on the applicator a tubular sheath at least partially surrounding the makeup product block. The sheath, rigid or flexible, can have one open end through which the block can project and/or cutouts or slits in its wall to expose parts of the makeup product block. The sheath can be sculptured on its exterior.

BRIEF DESCRIPTION OF THE DRAWINGS

For better understanding of the invention, particular and nonlimiting embodiments thereof will now be described with reference to the attached drawings wherein.

DETAILED DESCRIPTION OF PREFERRED EMBODIMENTS

Figure 1:
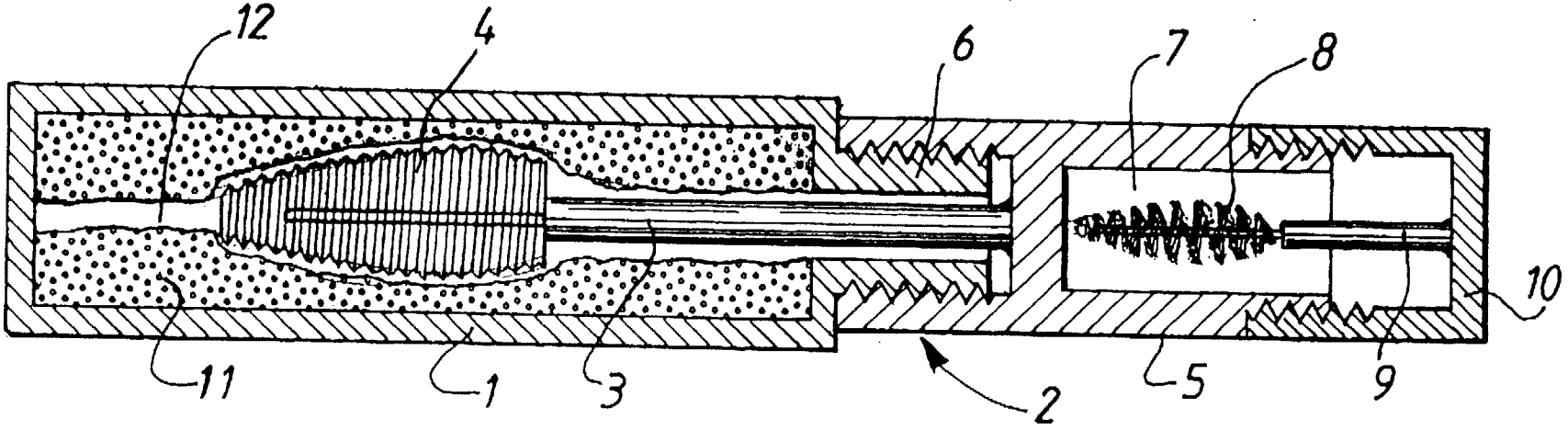
FIG. 1 is a cross-sectional view of a mascara packaging and application device according to the present invention.

Reference will first be made to FIG. 1.

The device has an elongate tubular body 1 and an applicator designated overall by 2.

Applicator 2 has a rod 3 which can be made of rigid or flexible material, at the end of which is provided a mascara block 4 which has a shaped elongate form and has a striated surface.

At its opposite end, rod 3 is joined to a gripping element 5 which can be screwed into part of the neck 6 of body 1.

Gripping element 5 has an internal cavity accommodating an additional applicator element in the form of an eyelash brush 8 whose rod 9 is integral with an end cap 10 that can be screwed onto the rear end of gripping element 5.

This brush 8 is intended to allow finishing of the lashes to which the mascara has previously been applied by applicator 2 by bringing mascara block 4 into contact with the lashes.

Figure 11:
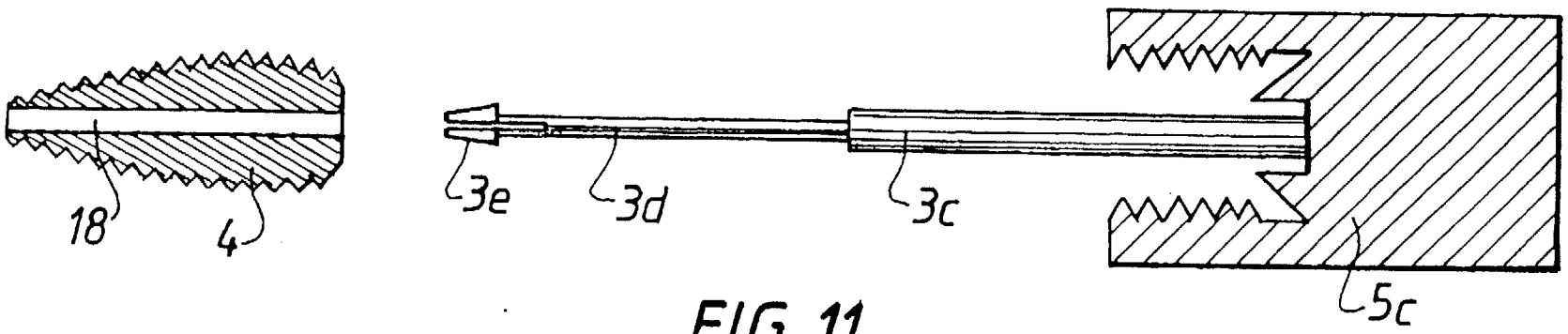

Body 1 contains a cartridge formed of a pad 11 made of open-cell flexible foam, for example polyurethane or polyether, occupying the internal volume of body 1. The pad has an elongate shape and is provided with a small-diameter axial cavity 12 allowing introduction of mascara block 4 at the end of its rod 3. The pad preferably has a larger external cross section than the mouth section of body 1 to allow the pad to be retained in the body. The external cross section of pad 11 can be approximately the same as the internal cross section of the body or alternatively, as illustrated in FIG. 11, be less than this cross section to favor expansion of the pad when the applicator is placed in the interior.

The external cross section of the pad can have any size and in particular be substantially cylindrical as illustrated, or have a shape, particularly multilobular (not shown) that favors expansion when the applicator is placed in axial cavity 12 of the pad.

Pad 11 is soaked in a liquid constituting a solvent for the mascara in order to crumble it, such as water, polypropylene glycol, or isoparaffin.

The liquid in which pad 11 is soaked can also advantageously contain cosmetically active agents, particular agents such as ceramides, pantenol, or preservatives that are normally incorporated into the composition of the mascara and which, with the present invention, can be added to the solvent. The invention increases the effectiveness of such agents in that they can come into contact with the lashes almost in their entirety while, when they are present in the mascara itself, much of them is encapsulated in the wax and the other ingredients of which the mascara is composed.

Figure 2:
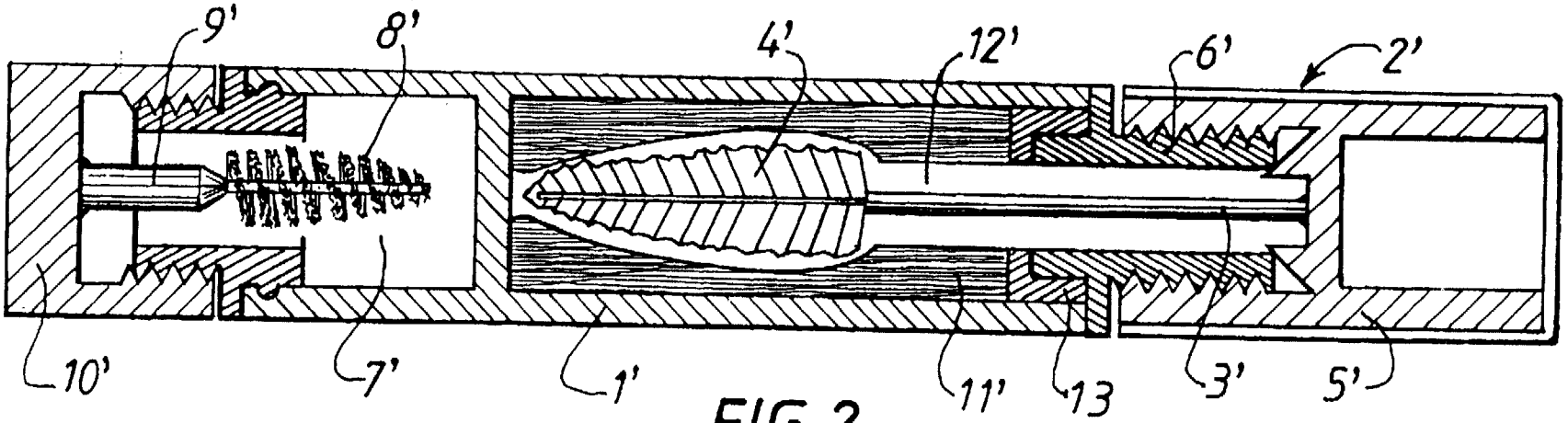
FIG. 2 is a view similar to FIG. 1 is a second embodiment.

Reference will now be made to FIG. 2 in which the components that correspond functionally to those of the embodiment of FIG. 1 are designated by the same reference numbers with the superscript (').

In this embodiment, mascara block 4' has the shape of a feather with external striations, and pad 11' accommodating mascara block 4' at the end of rod 3' of applicator 2' is made from fibers, particularly of cellulose.

As in the previous embodiment, applicator gripping element 5' is screwed onto part of neck 6' of the body. In this embodiment, a sealing tip 13 is also provided at the rear end of the body. Pad 11' has an axial channel 12' for penetration of the applicator.

By contrast with the previous embodiment, additional brush 8' is not accommodated in the applicator gripping element but in a cavity 7' provided at the end of the body opposite the applicator gripping element. Rod 9' of the brush is integral with an end gripping part 10'.

Figure 3:
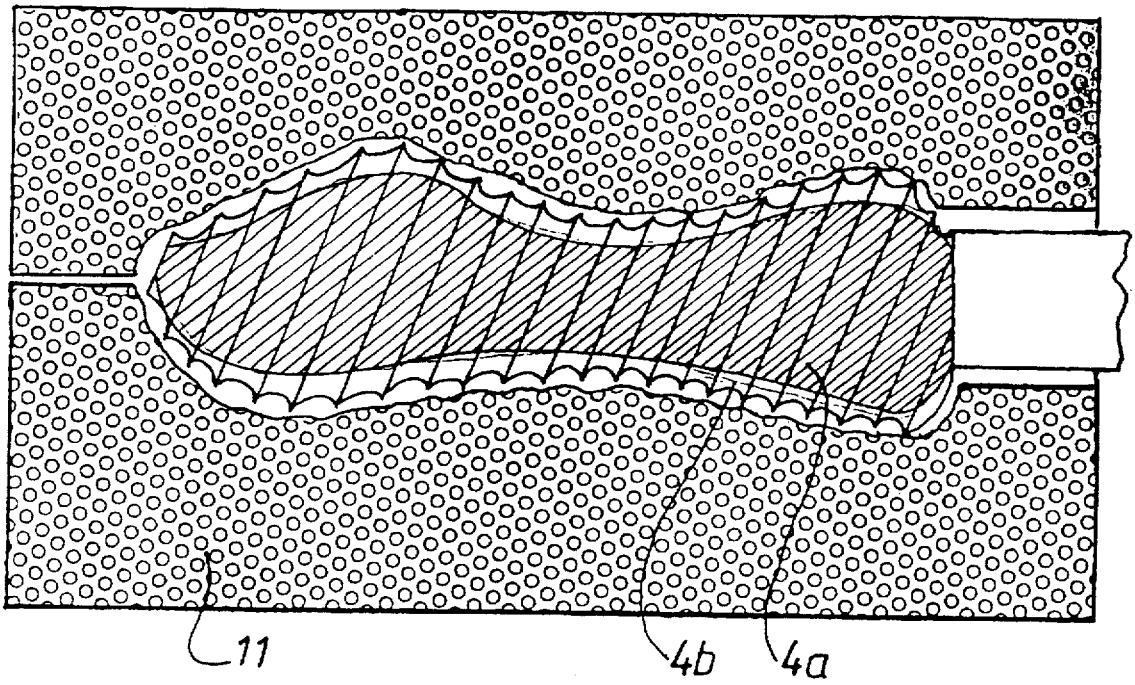
FIGS. 3, 4, 5, 6, 7, and 8 illustrate variants of the application element of the device according to the invention.

FIG. 3 illustrates an alterative embodiment of the application element in the form of a block of mascara which, in this case, is comprised of a harder central zone **4*a* coated externally with a softer and hence more easily crumbling zone 4*b***.

Figure 4:
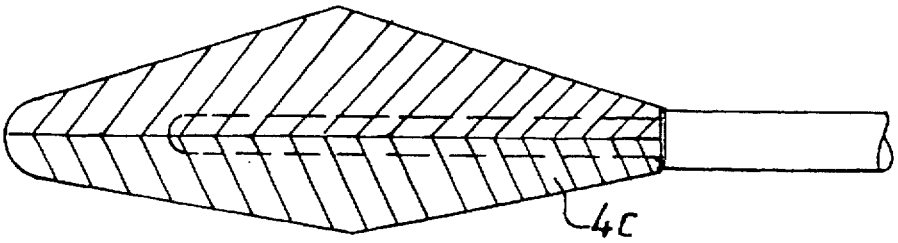
Figure 5:
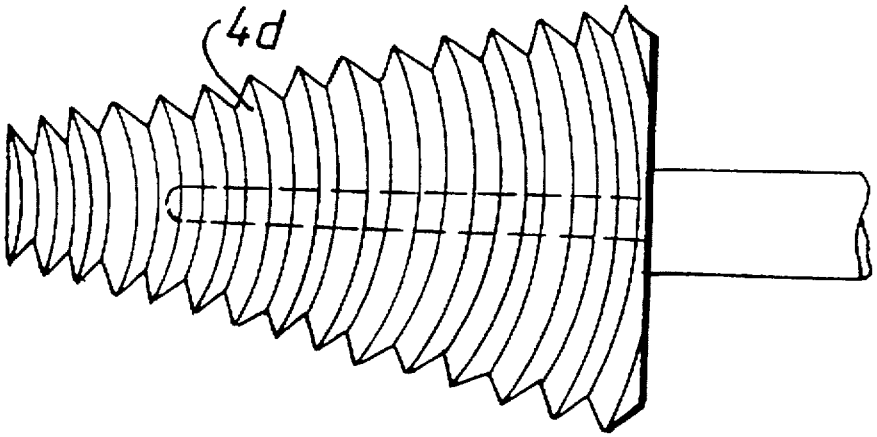

FIGS. 4 and 5 illustrate alternative mascara block configurations: biconical, **4*c*, and arrowhead-shaped, 4*d***, which can be envisaged in the framework of the present invention.

Figure 6:
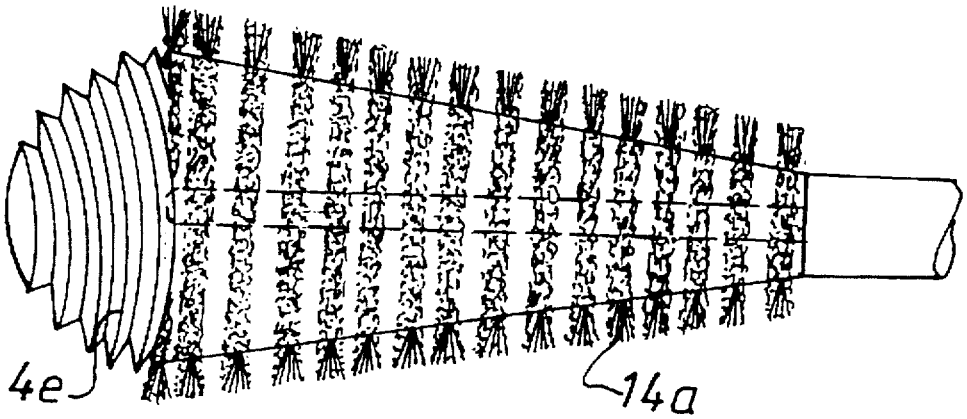
Figure 7:
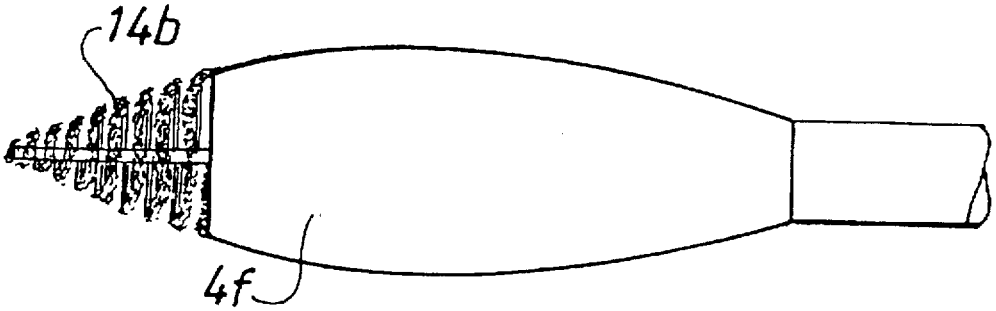
Figure 8:
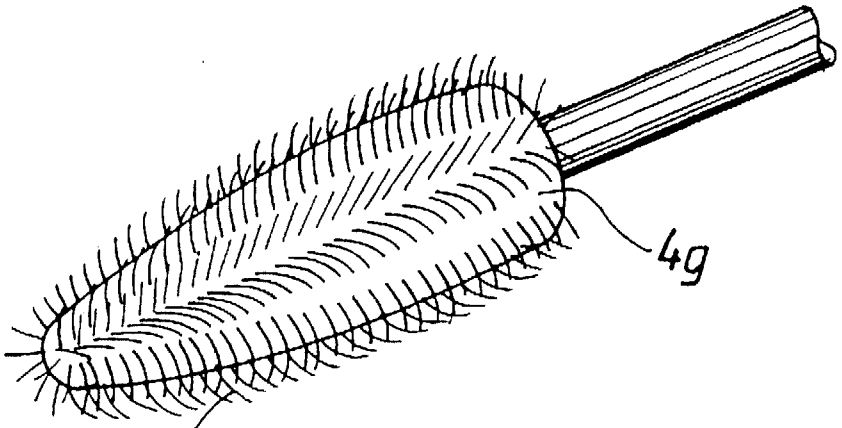

FIGS. 6 to 8 illustrate configurations of application elements wherein mascara block **4*e*, 4*f*, and 4*g* is formed on an eyelash brush 14*a*, 14*b*, and 14*c***, respectively, the bristles of which project partly from its surface before the first utilization.

Figure 9:
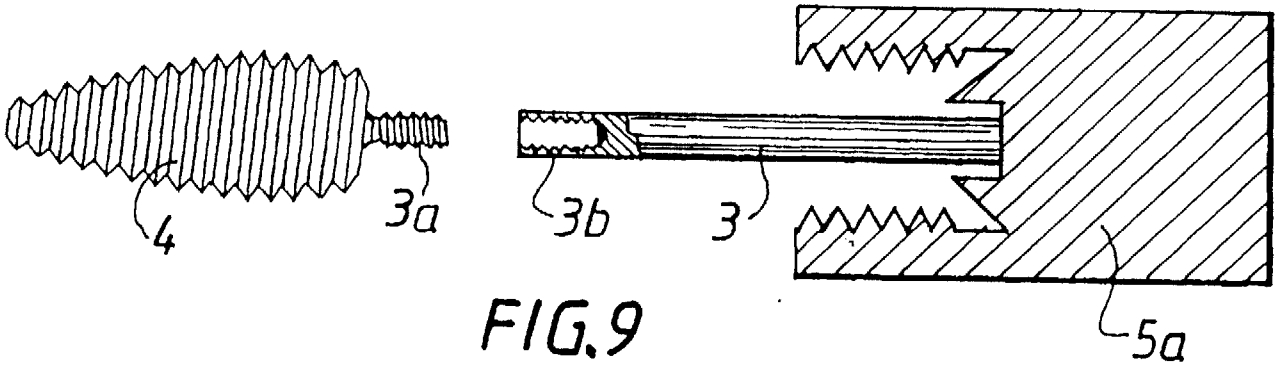
FIGS. 9 to 11 illustrate alterative embodiments of applications according to the invention.
Figure 10:
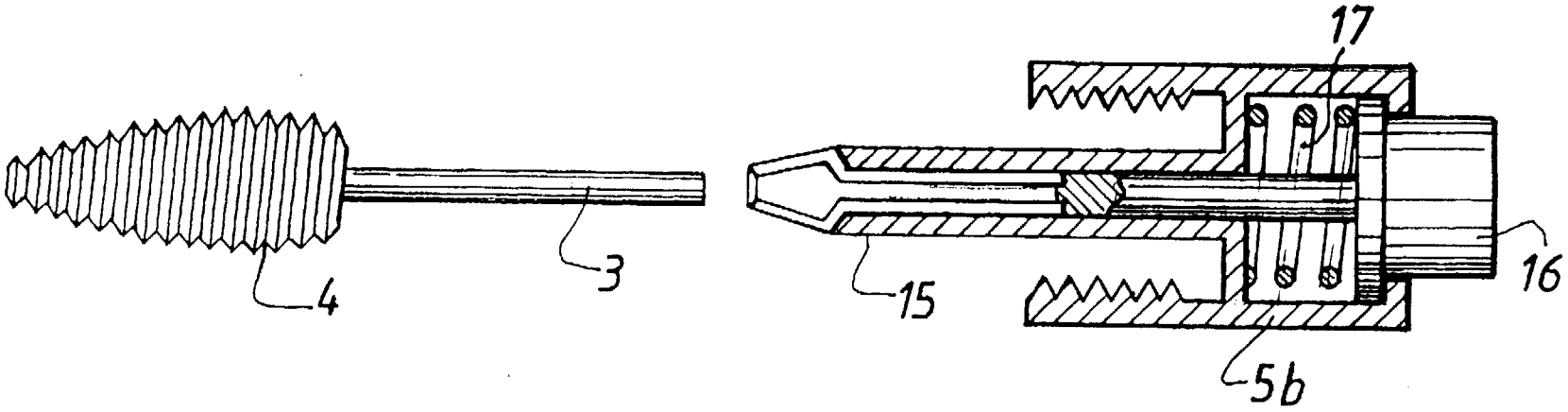

FIGS. 9 to 11 show applicators of devices according to the invention wherein makeup product block 4 is connected to gripping element **5*a*, 5*b*, and 5*c*** of the applicator by means allowing separable assembly.

In the embodiment of FIG. 9, block 4 is made on a section of threaded rod **3*a* that can be screwed into a tapped end part 3*b* of rod 3 integral with gripping element 5*a***.

In the embodiment of FIG. 10, rod 3 on which mascara product block 4 is formed is retained by a part 15 forming a clamp, opening of which is controlled by a pushbutton 16 held at the rear of gripping part **5*b* of the applicator which is pressed in against the force of a return spring 17**.

In the embodiment illustrated in FIG. 11, makeup product block 4 has an axial cavity 18 engaged by an extension **3*d* of rod 3*c* integral with gripping part 5*c*. Extension 3*d* has an end part 3*e* shaped like an elastic harpoon able to transverse the entire length of axial cavity 18 of makeup product block 4 while being compressed radially. As it emerges at the front of the makeup product block, end part 3*e*** ensures axial retention of the makeup product block on the rod.

Figure 12:
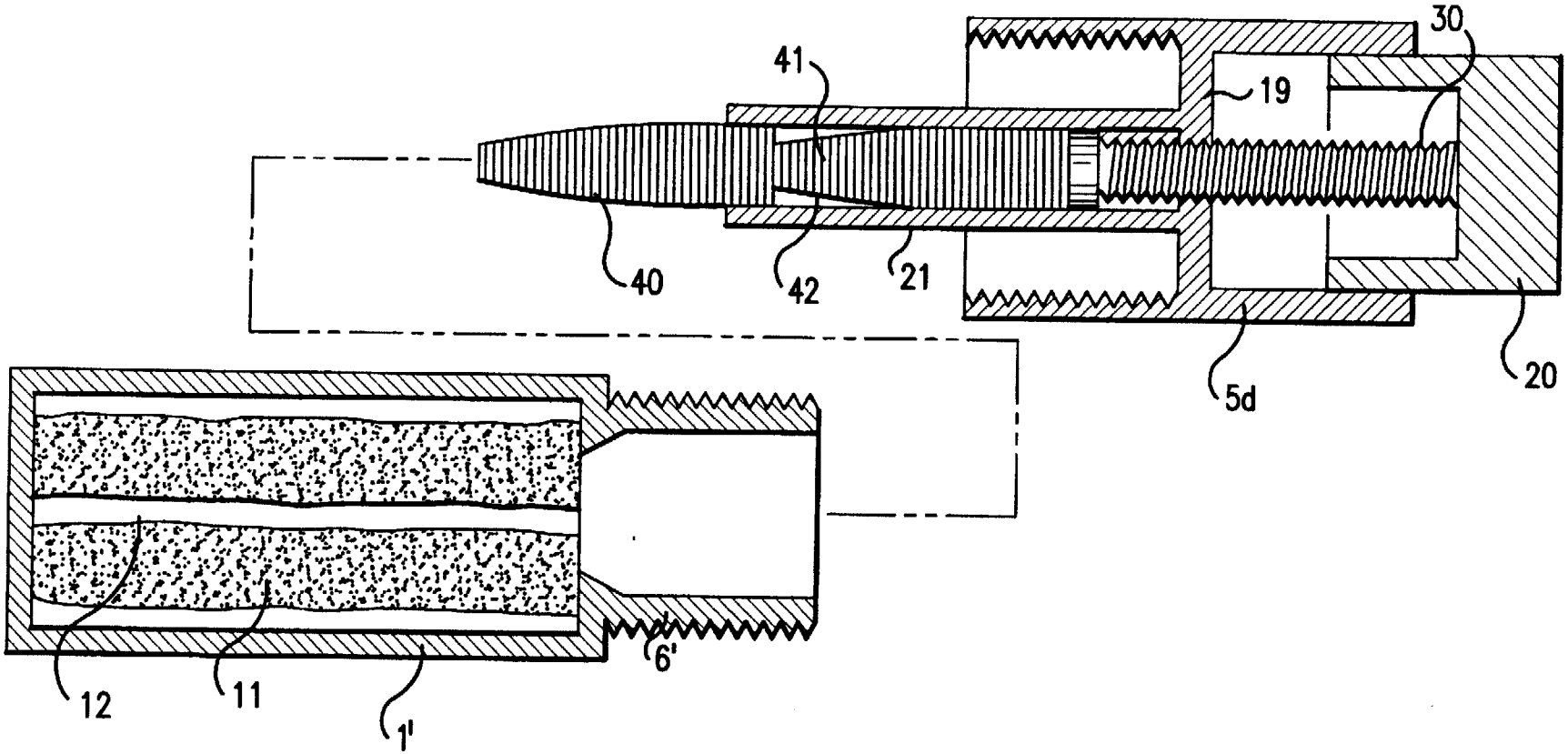
FIG. 12 represents a third embodiment of the device according to the invention in the open position.

In the embodiment of the device according to the invention illustrated in FIG. 12, pad 11 has a small external cross section by comparison with the internal cross section or tubular body 1', this section, however, being greater than that of neck part 6'.

The external cross section of pad 11 can in particular be noncircular.

Gripping element **5*d* of the applicator has an internal wall 19 provided axially with a tapped passage through which threaded rod 30** constituting the support of the makeup product block can move by screwing.

This block is made in the form of two shaped sections 40, 41 defining between them an area with a smaller cross section whereby the two sections can be separated by shearing force when foremost portion 40 is used up.

Rod 30 is integral at its rear end with an operating button 20 whereby the rod can be advanced by rotation.

According to the invention, a tubular sheath 21 is provided, open at its front end in the example illustrated, in which the makeup product block part of which projects forward to constitute an application element is partially accommodated.

As indicated previously, the liquid contained in the pad accommodated in the body of the device has the function of moistening the mascara block and hence crumbling it at its surface.

The pad in which the mascara block rubs internally and constituting the application element also causes surface abrasion of the mascara block; the abrasive effect can be modified by using materials of different densities and different hardnesses to make the pad.

Thus, when the applicator is removed from the body, an approximate quantity of mascara at the surface of the block can be deposited directly on the lashes by simple contact with the mascara block at the end of the applicator.

Although the invention has been described in connection with specific embodiments, it is obvious that it is not limited thereto and that variants and modifications may be made therefrom without thereby departing from its framework or spirit.

What is claimed is:

1. Device for a makeup product comprising an elongate body and an applicator that can be engaged in said body, the applicator having a rod provided at one end with a makeup product application element and the rod being connected at the other end to a gripping element, said body having a liquid reservoir in which the application element may be engaged, the application element comprising an elongate block of a makeup product to be applied, said liquid reservoir containing a liquid which is different from the makeup product of said elongate block.

2. Device according to claim 1, wherein the liquid reservoir has an elastically deformable flexible pad provided with an axial cavity to receive the application elements.

3. Device according to claim 2, wherein the pad contains a solvent.

4. Device according to claim 3, wherein the pad further contains cosmetically active agents.

5. Device according to claim 2, wherein said pad has a fibrous structure.

6. Device according to claim 2, wherein said pad has a cellular structure.

7. Device according to claim 1, wherein the makeup product block is formed directly on the rod of the applicator.

8. Device according to claim 7, wherein the makeup product block is formed on the rod by hot molding.

9. Device according to claim 1, therein the makeup product block is formed on a brush provided at the one end of the rod.

10. Device according to claim 9, wherein bristles of the brush protrude from the makeup product block.

11. Device according to claim 9, wherein the makeup product block is formed on the brush by dipping.

12. Device according to claim 9, wherein the makeup product block is formed on the brush by molding.

13. Device according to claim 1, wherein the makeup product block is mounted separably on the rod of the applicator.

14. Device according to claim 1, wherein the rod is separably connected to the gripping element.

15. Device according to claim 1, wherein the applicator has a tubular sheath surrounding the makeup product block.

16. Device according to claim 1, wherein the applicator further comprises a finish application element accommodated in the gripping element of the applicator.

17. Device according to claim 16, wherein the finish application element is a brush.

18. Device according to claim 1, wherein the makeup product block comprises a mascara.

19. Device according to claim 1, wherein an external surface of the makeup product block is striated.

20. Device according to claim 1, wherein the makeup product block comprises a core and a coating wherein the core is harder than the coating.

21. Device according to claim 1, wherein the gripping element also constitutes a cap able to close an orifice of the body in which the applicator is engaged.

22. Device for a makeup product comprising an elongate body and an applicator that can be engaged in said body, the applicator having a rod provided at one end with a makeup product application element and the rod being connected at the other end to a gripping element, said body having a liquid reservoir in which the application element may be engaged, and the application element comprising, when engaged or not in said liquid reservoir, an elongate block of a makeup product to be applied.

23. Device according to claim 22, wherein the applicator further comprises a finish application element accommodated at the end of the body opposite the gripping element.

24. Device for a makeup product comprising an elongate body and an applicator that can be engaged in said body, the applicator having a rod provided at one end with a makeup product application element and the rod being connected at the other end to a gripping element, said body having a liquid reservoir in which the application element may be engaged, the application element comprising an elongate block of a makeup product to be applied, wherein the liquid reservoir has an elastically deformable flexible pad provided with an axial cavity to receive the application element.

25. Device for a makeup product comprising an elongate body and an applicator that can be engaged in said body, the applicator having a rod provided at one end with a makeup product application element and the rod being connected at the other end to a gripping element, said body having a liquid reservoir in which the application element may be engaged, the application element comprising an elongate block of a makeup product to be applied, wherein the makeup product block is formed directly on the rod of the applicator by hot molding.

26. Device for a makeup product comprising an elongate body and an applicator that can be engaged in said body, the applicator having a rod provided at one end with a makeup product application element and the rod being connected at the other end to a gripping element, said body having a liquid reservoir in which the application element may be engaged, the application element comprising an elongate block of a makeup product to be applied, wherein the makeup product block is mounted separably on the rod of the applicator.

27. Device for a makeup product comprising an elongate body and an applicator that can be engaged in said body, the applicator having a rod provided at one end with a makeup product application element and the rod being connected at the other end to a gripping element, said body having a liquid reservoir in which the application element may be engaged, the application element comprising an elongate block of a makeup product to be applied, wherein the makeup product block comprises a core and a coating, wherein the core is harder than the coating.

* * * * *